US008770873B2

(12) United States Patent
Sato

(10) Patent No.: US 8,770,873 B2
(45) Date of Patent: Jul. 8, 2014

(54) INK RIBBON CASSETTE AND PRINTING APPARATUS

(75) Inventor: Haruo Sato, Fukushima-ken (JP)

(73) Assignee: Oki Data Corporation, Tokyo (JP)

( * ) Notice: Subject to any disclaimer, the term of this patent is extended or adjusted under 35 U.S.C. 154(b) by 737 days.

(21) Appl. No.: 12/071,972

(22) Filed: Feb. 28, 2008

(65) Prior Publication Data

US 2008/0232889 A1 Sep. 25, 2008

(30) Foreign Application Priority Data

Mar. 19, 2007 (JP) ..... 2007-071163

(51) Int. Cl.
*B41J 32/00* (2006.01)
*B41J 31/00* (2006.01)
*B41J 32/02* (2006.01)

(52) U.S. Cl.
CPC . *B41J 32/00* (2013.01); *B41J 31/00* (2013.01); *B41J 32/02* (2013.01)
USPC ..... 400/196; 400/207

(58) Field of Classification Search
CPC ..... B41J 32/00; B41J 31/00; B41J 32/02
USPC ..... 400/194, 196, 197, 207, 208
See application file for complete search history.

(56) References Cited

U.S. PATENT DOCUMENTS

| | | | | |
|---|---|---|---|---|
| 3,993,182 | A * | 11/1976 | Steinke | 400/195 |
| 4,071,133 | A * | 1/1978 | Scherrer et al. | 400/196 |
| 4,130,367 | A | 12/1978 | Guerrini et al. | |
| 4,210,403 | A | 7/1980 | Mazouet et al. | |
| 4,645,364 | A * | 2/1987 | Ohsaki | 400/248 |
| 4,741,640 | A | 5/1988 | Yoshioka | |
| 4,749,293 | A * | 6/1988 | Beer et al. | 400/196.1 |
| 4,828,411 | A * | 5/1989 | Oba | 400/196.1 |
| 4,830,524 | A * | 5/1989 | Shore | 400/208 |
| 4,840,503 | A * | 6/1989 | Roberts et al. | 400/208 |
| 5,083,878 | A * | 1/1992 | Surti | 400/235.1 |
| 5,139,352 | A * | 8/1992 | Kawahara | 400/208 |
| 5,348,403 | A * | 9/1994 | Mizutani et al. | 400/196 |
| 5,403,103 | A * | 4/1995 | Ayres | 400/208 |
| 5,487,615 | A * | 1/1996 | Hayao | 400/207 |
| 5,567,065 | A * | 10/1996 | Cai et al. | 400/202.4 |
| 5,746,522 | A * | 5/1998 | Moreland | 400/197 |
| 6,736,558 | B2 * | 5/2004 | Sun et al. | 400/235 |
| 2009/0238627 | A1 * | 9/2009 | Nihashi | 400/194 |

FOREIGN PATENT DOCUMENTS

| | | |
|---|---|---|
| EP | 0 240 112 A1 | 10/1987 |
| GB | 2 033 872 A | 5/1980 |
| GB | 2 184 998 A | 7/1987 |
| JP | 54-48715 | 4/1979 |

(Continued)

*Primary Examiner* — David Banh
(74) *Attorney, Agent, or Firm* — Rabin & Berdo, P.C.

(57) ABSTRACT

An ink ribbon cassette is used in a printing apparatus. The cassette is able to prevent dual movement of an ink ribbon from moving across a lengthways embankment even if the ink ribbon is extended. In the ink ribbon cassette, a lengthways embankment is furnished near an ejecting opening of ink ribbon cassette in an ink ribbon lodging section. The lengthways embankment makes a portion of a space that the ink ribbon passes through narrower. Dual embankments may also be furnished on the ink ribbon movement path at the downstream side of ink ribbon lodging section. The dual embankments respectively protrude from an upper cover and a lower cover. Protruding portions may also be respectively furnished near an entering opening and an ejecting opening of ink ribbon lodging section.

15 Claims, 15 Drawing Sheets

(56) References Cited

FOREIGN PATENT DOCUMENTS

| | | |
|---|---|---|
| JP | 58-69085 | 4/1983 |
| JP | 61-62057 | 4/1986 |
| JP | 4-91977 | 3/1992 |
| JP | H05-035327 | 5/1993 |
| JP | 6-55822 | 3/1994 |

* cited by examiner

INK RIBBON CASSETTE AND PRINTING APPARATUS

BACKGROUND OF THE INVENTION

1. Field of the Invention

The invention relates to an ink ribbon cassette that lodges ink ribbon and a printing apparatus that includes such an ink ribbon cassette.

2. Related Background Art

FIG. 16 is a diagram showing a structure of a conventional ink ribbon cassette.

As shown by FIG. 16, in an ink ribbon cassette 1, an ink ribbon 3 is sandwiched and is taken into an ink ribbon lodging section 6 by rotation of a drive gear 10 and a transfer gear 7. The ink ribbon 3, while guided by an embankment 4*a* formed on lower cover 12 and an embankment 4*b* that will be mentioned below, is drawn out from the ink ribbon lodging section 6 as a strip of ink ribbon.

FIG. 17 is a longitudinal section diagram showing a conventional embankment part.

As shown in FIG. 17, the embankment 4*a* is formed on the lower cover 12 and the embankment 4*b* is formed on an upper cover 11. Then, because the ink ribbon 3 is drawn out while being controlled from two sides (i.e. along a vertical direction in FIG. 17) through the embankment 4*a* and the embankment 4*b*, the ink ribbon 3 dose not overlap and does not "dash out." (e.g. refer to patent document 1).

Patent document 1: Japan utility model publication H05-035327.

However, in order to prolong the life of the ink ribbon cassette 1, it is necessary to extend the length of the ink ribbon 3.

FIG. 18 is a diagram showing an operation of a conventional ink ribbon cassette. As shown in FIG. 18, to extend the length of the ink ribbon 3, the ink ribbon 3 is difficult to arrange to be properly lodged. As illustrated, the ink ribbon 3 falls into a state of disorder as shown at area H. Further, the back part of the ink ribbon 3 outstrips the front part of the ink ribbon 3 as shown at area F2.

In such a state, there is the following problem. That is, in the conventional ink ribbon cassette 1, though the ink ribbon 3 does not dash out by the embankment 4*a* and the embankment 4*b*, front and the back parts of the ink ribbon 3 are synchronously drawn out because of a friction caused when the ink ribbon 3 is drawn out. Then the ink ribbon 3 moves across the embankment 4*a* and the embankment 4*b* as shown at area G2, and therefore the ink ribbon 3 has a dual movement causing a ribbon jam.

SUMMARY OF THE INVENTION

It is, therefore, an object of the invention to provide an ink ribbon cassette and a printing apparatus capable of solving the above problem.

According to some embodiments of the invention, an ink ribbon cassette includes a first cover and a second cover. An ink ribbon lodging section, that includes the first cover and the second cover, lodges ink ribbon in a folded state. A driving section takes the ink ribbon from an enter opening of the ink ribbon lodging section into the ink ribbon lodging section and draws the ink ribbon out from an ejecting opening of the ink ribbon lodging section. A first embankment is furnished proximate the ejecting opening and inside the ink ribbon lodging section. The first embankment pushes the ink ribbon in a width direction of the ink ribbon. A movement path is furnished between the first cover and the second cover. The ink ribbon that is drawn out from the ink ribbon lodging section moves along the movement path. A guide member is furnished in the movement path and is formed in the movement path so as to make the movement path narrower in a thickness direction of the ink ribbon. A pair of second embankments is furnished in the movement path and proximate the ejecting opening of the ink ribbon lodging section. The pair of second embankments pushes the ink ribbon in the width direction of the ink ribbon. The second embankments have rib shapes protruding toward an inside of the movement path from both of the first cover and the second cover. Each of the second embankments has a height along the width direction of the ink ribbon that is greater than a height of the first embankment along the width direction of the ink ribbon.

Effect of the present invention

According to the ink ribbon cassette and the printing apparatus of the present invention, a lengthways embankment, whose transverse width becomes more wide towards a downstream side of movement of the ink ribbon, is provided near an ejecting opening of an ink ribbon lodging section. Therefore, even in the case that the ink ribbon is extended to prolong the life of the ink ribbon cassette, it is possible to prevent dual movement of the ink ribbon across the lengthways embankment.

The features of the present invention will become apparent from the following detailed description and the appended claims with reference to the accompanying drawings.

DETAILED DESCRIPTION OF THE PREFERRED EMBODIMENTS

Embodiments of the invention will be described in detail hereinbelow with reference to the drawings. In the following embodiments, regarding the same element used in common, the same symbol is assigned.

Embodiment 1

Structure:

Initially, a structure and an external view of a printing apparatus 15 with an ink ribbon cassette 1 of embodiment 1 are described.

Figure 4:
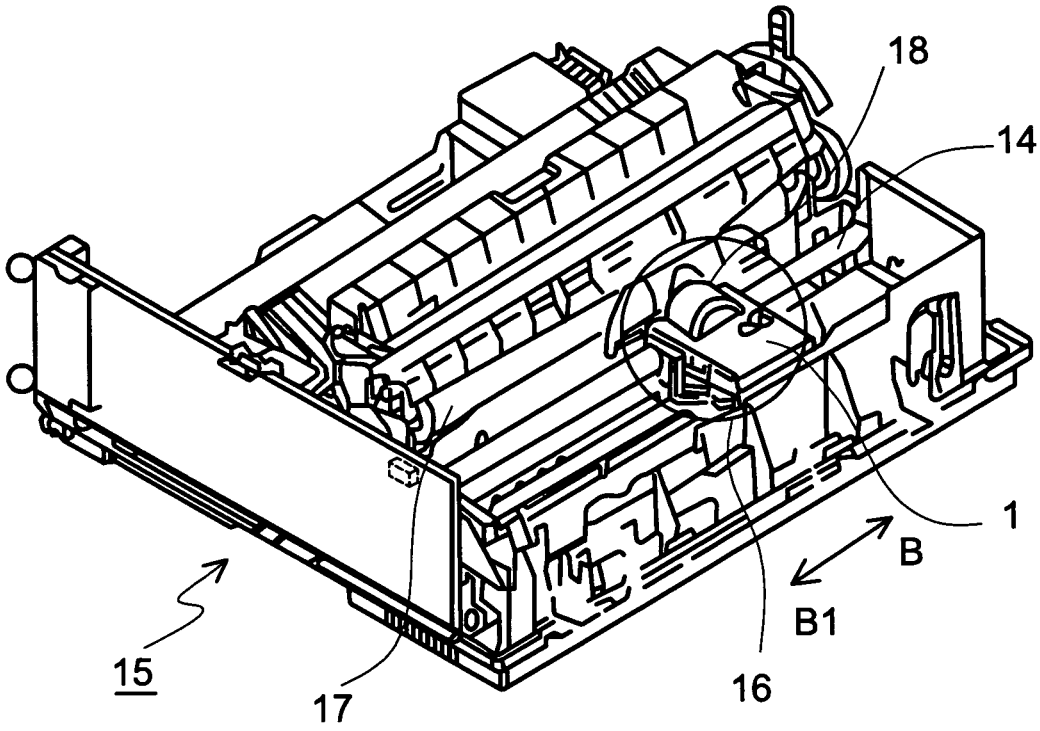
FIG. 4 is a diagram showing a summary structure of a printing apparatus in embodiment 1 of the present invention.
Figure 5:
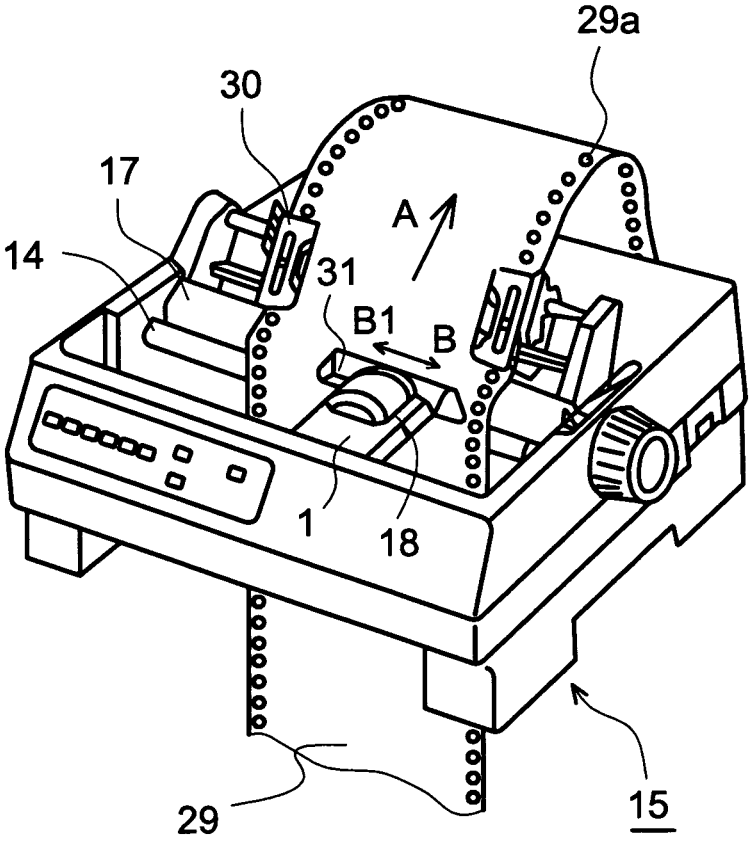
FIG. 5 is a cubic diagram showing an external view of a printing apparatus in embodiment 1 of the present invention.

FIG. 4 is a diagram showing a structure of a printing apparatus in embodiment 1 of the present invention; and FIG. 5 is a cubic diagram showing an external view of a printing apparatus in embodiment 1 of the present invention.

The printing apparatus shown in FIGS. 4 and 5 is that of bottom-pull type, which uses a printing head 18 to perform a print while using a pull up tractor 30 to pull up, for example, sprocket paper 29 which serves as a medium.

As shown in FIG. 4, in a carriage assembly 16, an ink ribbon cassette 1 is installed to hold the printing head 18. A platen 17 and a carriage shaft 14 are installed in parallel. The carriage assembly 16 is slidably installed on the carriage shaft 14, and moves while spacing along an arrow B-B1 direction that is a shaft direction of the platen 17 through a drive source (not shown) that rotates.

The printing head 18 is driven to correspond to the timing of a spacing operation and is pressed by a ribbon guide 31 as shown FIG. 5. The printing head 18 then performs a print with respect to a continuous paper medium such as sprocket paper 29 or the like wrapped round the platen 17.

Moreover, on both sides of the sprocket paper 29, sprocket holes 29*a* are respectively provided along the movement direction of the sprocket paper 29, and fits a post (not shown) furnished on the pull up tractor 30, that then moves along an arrow A direction while being fixed.

That is, the structure is that the carriage assembly 16 installs the printing head 18 and the ink ribbon cassette 1, while sliding along the carriage shaft 14 furnished in parallel with the platen 17, and spaces the printing head 18 along the arrow B-B1 direction. To correspond to the timing of the operation, plural wires (not shown) provided inside the ink ribbon cassette 1 are driven along the arrow A direction, and impacted via ink ribbon (not shown) lodged in the ink ribbon cassette 1, then a print is performed with respect to the sprocket paper 29.

Figure 6:
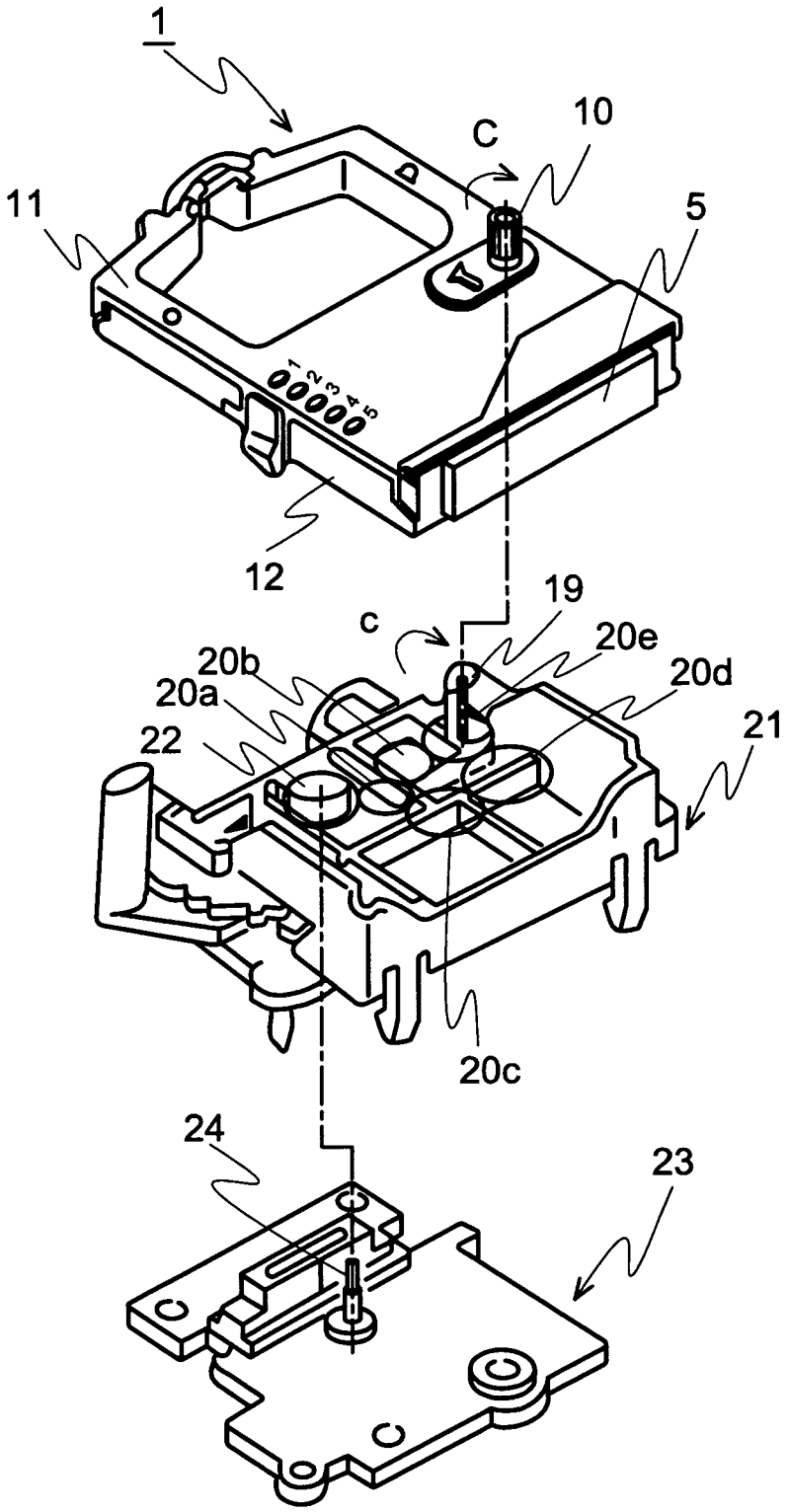
FIG. 6 is a diagram showing an installation structure of an ink ribbon cassette of a cartridge assembly in embodiment 1 of the present invention.

FIG. 6 is a diagram showing an installation structure of an ink ribbon cassette of a cartridge assembly in embodiment 1 of the present invention.

A space motor shaft 24 is installed on a space motor 23, and is connected with a ribbon gear 22 of a ribbon feed gear assembly 21. Then, power from the space motor 23 is transmitted to a ribbon drive gear 19 via plural gear arrangements 20*a*~20*e*, and the ribbon drive gear 19 is rotated along a direction of arrow C.

The ribbon drive gear 19 connects with the drive gear 10 of the ink ribbon cassette 1, and takes in the ink ribbon that is lodged in the ink ribbon cassette 1 and is mentioned below through rotating the drive gear 10 along the direction of arrow C. In an ink tank 5, ink is accommodated for providing the ink to the ink ribbon. The ink ribbon cassette 1 includes an upper cover 11 as an upper basket body, and a lower cover 12 as a lower basket body so as to form a structure covering a circumference. Moreover, regarding a drive method of the ink ribbon cassette 1, because it is not relative to the present invention, a detailed explanation thereof is omitted for simplification.

Figure 1A:
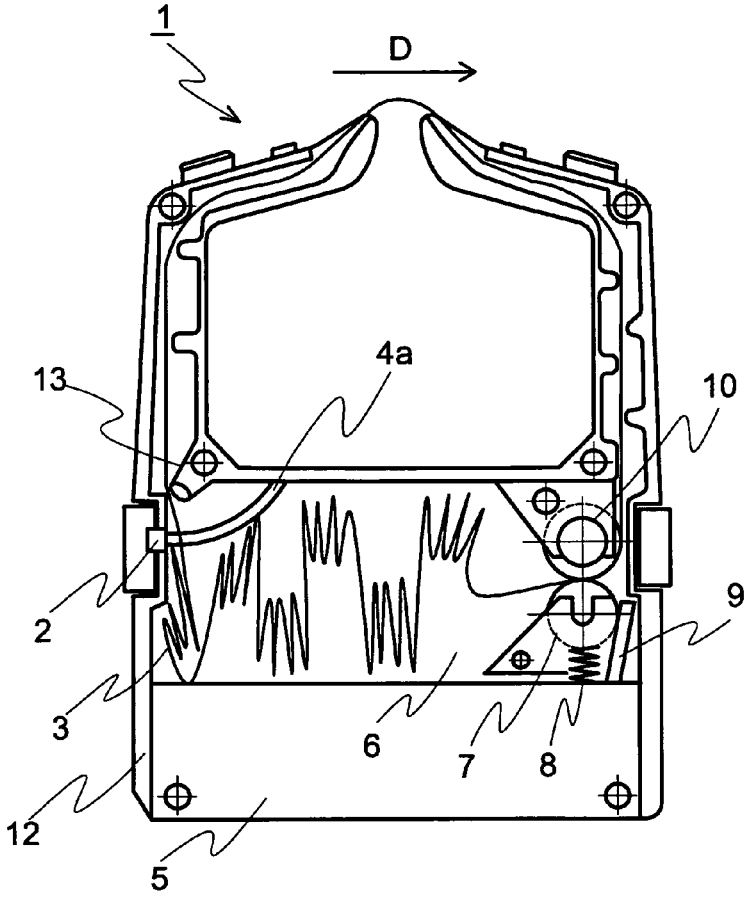
FIG. 1A is a diagram showing a structure of an ink ribbon cassette in embodiment 1 of the present invention and showing a state in that an upper cover is removed.
Figure 1B:
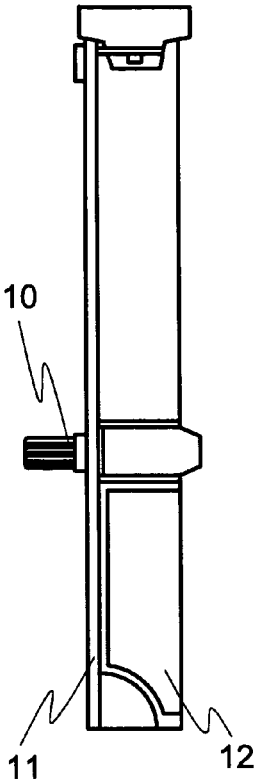
FIG. 1B is a diagram showing a side of an ink ribbon cassette in embodiment 1 of the present invention.

FIG. 1A is a diagram showing a structure of an ink ribbon cassette in embodiment 1 of the present invention and showing a state in that an upper cover is removed; and FIG. 1B is a diagram showing a side of an ink ribbon cassette in embodiment 1 of the present invention.

The ink ribbon cassette 1 shown in FIG. 1A is installed in the printing apparatus 15. The ink ribbon cassette 1 has its upper cover and its lower cover formed by the upper cover 11 and the lower cover 12 shown in FIG. 1B.

The ink ribbon cassette 1 includes an ink ribbon 3, an ink ribbon lodging section 6 to lodge the ink ribbon 3 in a folded shape, and an ink tank 5 to accommodate ink.

Near the entering opening, a drive gear 10 and a transfer gear 7 facing the drive gear 10 are furnished. Then, the ink ribbon 3 moves on a direction along arrow D and through the drive gear 10 and the transfer gear 7 that sandwich and roll the ink ribbon 3. Further, under the transfer gear 7, a spring 8 is furnished to press the transfer gear 7 against the drive gear 10.

The ink tank 5 contains ink and supplies the ink to the ink ribbon 3 via a wick 9 and the transfer gear 7.

Near by the ejecting opening of the ink ribbon lodging section 6, an embankment 4*a* and an embankment 4*b*, also mentioned below, are furnished for preventing the ink ribbon 3 from dashing out. Further, on the inside surface of side wall on the outside of the lower cover 12, a lengthways embankment 2 is furnished for preventing the ink ribbon 3 from having dual movement (i.e. multiple feeding/dual feeding).

Figure 2A:
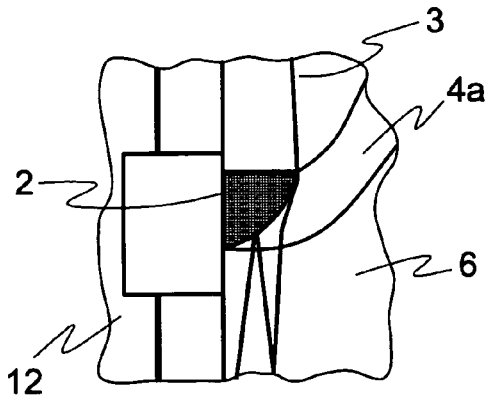
FIG. 2A is an enlarged diagram showing a detail structure of a lengthways embankment part in embodiment 1 of the present invention.
Figure 2B:
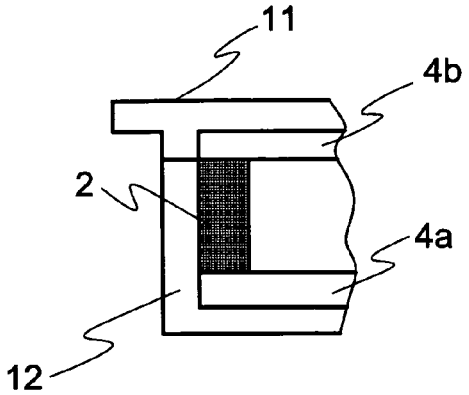
FIG. 2B is a longitudinal section diagram showing a detail structure of a lengthways embankment part in embodiment 1 of the present invention.

FIG. 2A is an enlarged diagram showing a detail structure of a lengthways embankment part in embodiment 1 of the present invention; and FIG. 2B is a longitudinal section diagram showing a detail structure of a lengthways embankment part in embodiment 1 of the present invention.

The lengthways embankment 2 is furnished on the lower side wall of the cover near the ejecting opening of the ink ribbon lodging section 6 so as to make a space that the ink ribbon 3 pass through become more and more narrow towards downstream movement side of the ink ribbon 3. The lengthways embankment 2 also uniformly extends from the embankment 4*a* of the lower cover 12 to the embankment 4*b* of the upper cover 11.

Moreover, regarding the shape of the lengthways embankment 2, it may be set to be capable of making the ink ribbon 3 space that the ink ribbon 3 pass through become more and more narrow towards the downstream movement side of the ink ribbon 3. The shape of the lengthways embankment 2 may also be set into that of convex type or the like.

Figure 3:
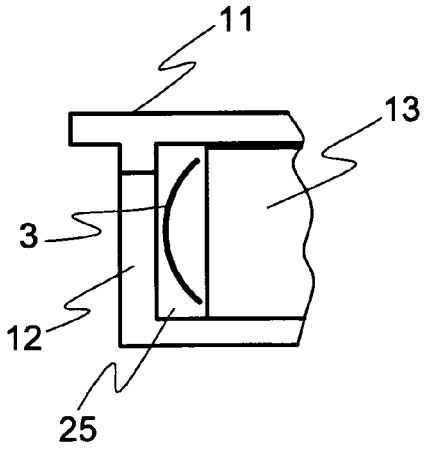
FIG. 3 is a longitudinal section diagram showing a circumference of a guide section in embodiment 1 of the present invention.

FIG. 3 is a longitudinal section diagram showing a circumference of a guide section in embodiment 1 of the present invention.

As shown by FIG. 3, because the inside surface of the side wall of the lower cover 12 and a guide section 13 makes the width of an ink ribbon movement path 25 become narrow.

That is, the decreasing width makes the ink ribbon 3 become pressed from an upside and an underside in an arc shape by the embankment 4*a* and the embankment 4*b* so that only the ink ribbon 3 passes. Therefore, even if the back part of the ink ribbon 3 outstrips the front part of the ink ribbon 3, it is possible to prevent the back part of the ink ribbon 3 from entering.

Operation:

According to the above-stated structure, the ink ribbon cassette and the printing apparatus of the embodiment 1 performs the following operation. Next is to explain the operation by using FIGS. 7~9.

Figure 7:
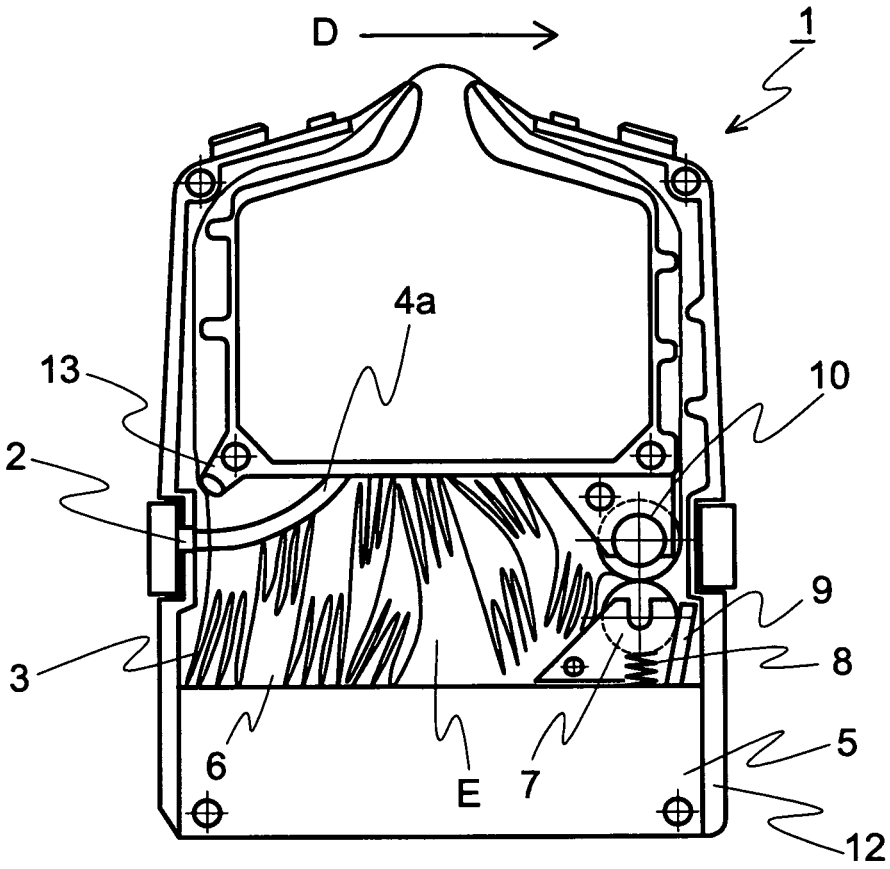
FIG. 7 is a first diagram showing operation of an ink ribbon cassette in embodiment 1 of the present invention.
Figure 8:
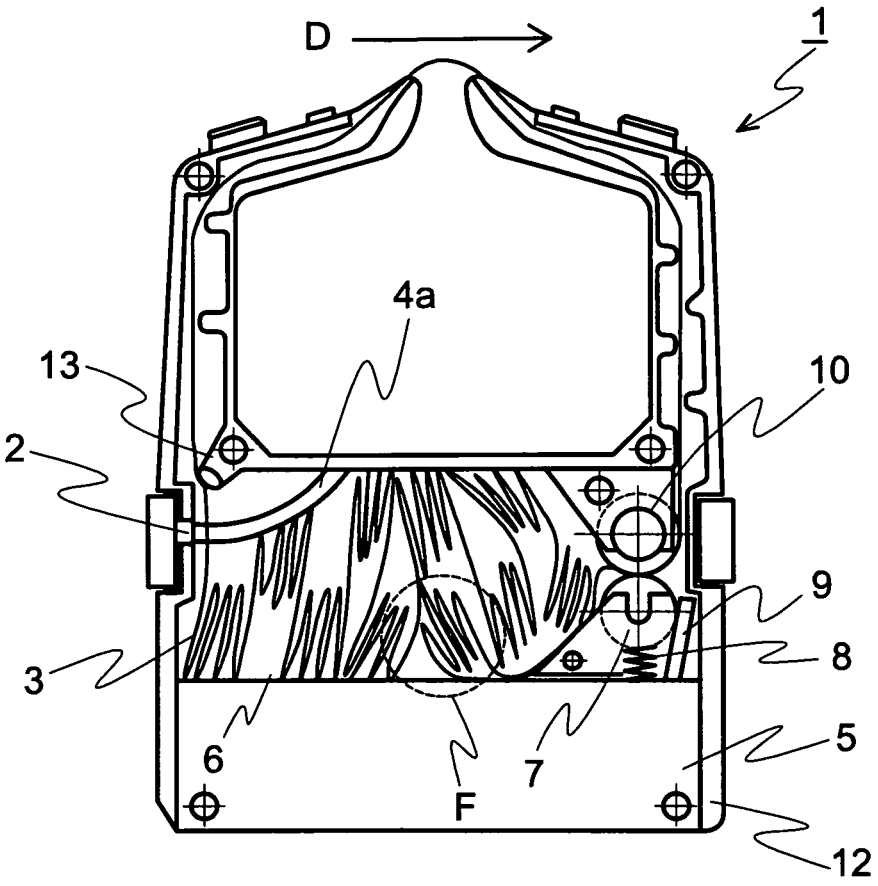
FIG. 8 is a second diagram showing operation of an ink ribbon cassette in embodiment 1 of the present invention.
Figure 9:
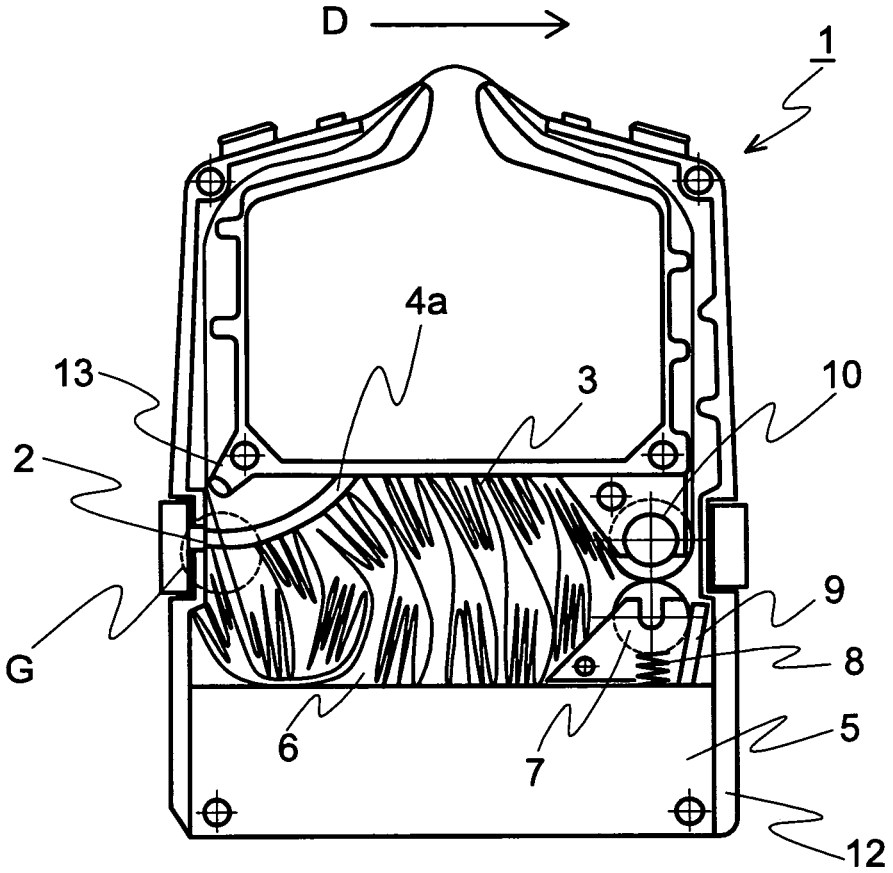
FIG. 9 is a third diagram showing operation of an ink ribbon cassette in embodiment 1 of the present invention.

FIG. 7 is a first diagram showing operation of an ink ribbon cassette in embodiment 1 of the present invention; FIG. 8 is a second diagram showing operation of an ink ribbon cassette in embodiment 1 of the present invention; FIG. 9 is a third diagram showing operation of an ink ribbon cassette in embodiment 1 of the present invention.

Initially, as shown by FIG. 7, the ink ribbon 3 is nipped by the drive gear 10 and the transfer gear 7, and is taken into the ink ribbon lodging section 6. Then the ink ribbon 3 is lodged into the ink ribbon lodging section 6 in a folded state.

However, in the ink ribbon lodging section 6, space E forms and force acts on the ink ribbon 3 to push out the ink ribbon 3 toward the ejecting opening. As shown by area F in FIG. 8, the back part of the ink ribbon 3 outstrips the front part of the ink ribbon 3 and enters the space E, in such a state, the ink ribbon 3 is conveyed to the ejecting opening.

At that time, the ink ribbon 3 in area F and conveyed to the ejecting opening has a tendency to be drawn out in company with the front part of the ink ribbon 3 that is drawn out due to a friction between the front and the back parts. However, as shown by area G in FIG. 9, because the foreside of the back part of the ink ribbon 3 comes into contact with the lengthways embankment 2, and the ink ribbon 3 is not caught since the inclination of the lengthways embankment 2, the back part of the ink ribbon 3 does not get over the embankment 4*a* and the embankment 4*b* so that there is no dual movement.

Further, the lower cover 12 and a guide section 13 make the width of the ink ribbon movement path 25 become narrow so that the ink ribbon 3 is pressed from upside and underside in an arc shape by the embankment 4*a* and the embankment 4*b*. Therefore, only the ink ribbon 3 passes, and it is possible to prevent the ink ribbon 3 from having dual movement.

Effect of the Embodiment 1:

As stated in detail above, according to the ink ribbon cassette and the printing apparatus in the embodiment 1, there is provided a lengthways embankment near the ejecting opening of an ink ribbon lodging section, whose transverse width becomes wider towards a downstream movement side. Therefore, even in the case that the ink ribbon is extended to prolong the life of the ink ribbon cassette, it is possible to prevent dual movement of the ink ribbon from getting across the lengthways embankment.

Embodiment 2

Figure 10:
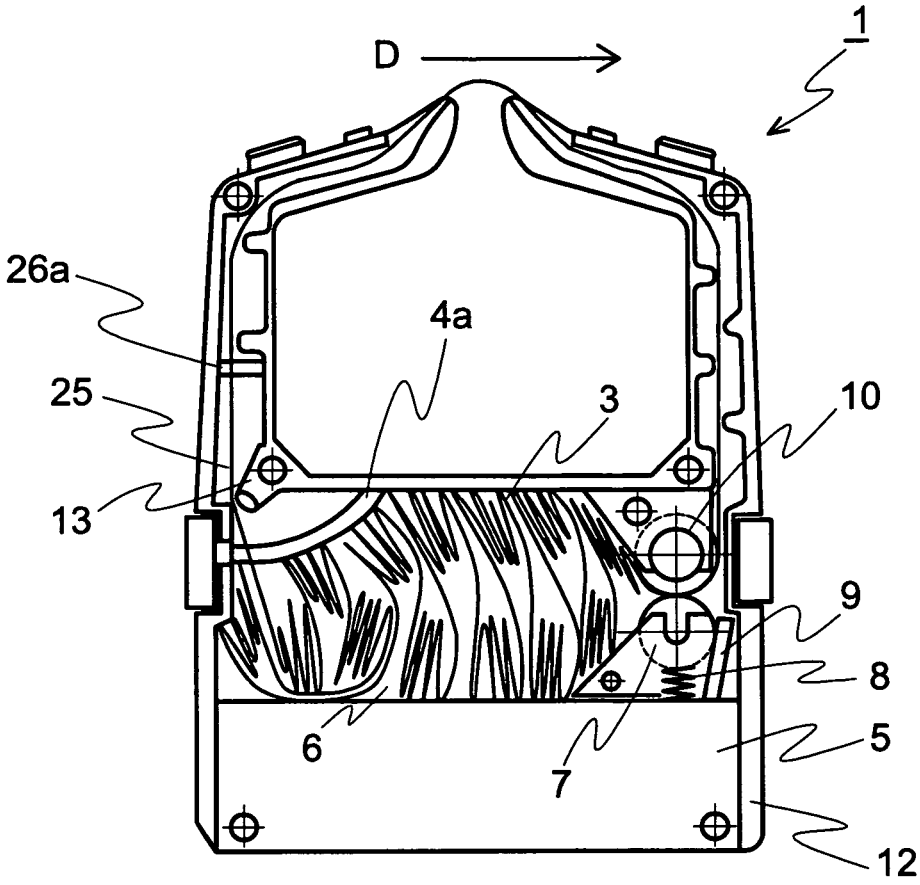
FIG. 10 is a diagram showing a structure of an ink ribbon cassette in embodiment 2 of the present invention.

Structure:

FIG. 10 is a diagram showing a structure of an ink ribbon cassette in embodiment 2 of the present invention.

As shown by FIG. 10, an ink ribbon cassette and a printing apparatus of the embodiment 2 respectively have a dual embankment 26*a* and a dual embankment 26*b* that are furnished on the ink ribbon movement path 25 on a downstream side of the ink ribbon lodging section 6.

Figure 11:
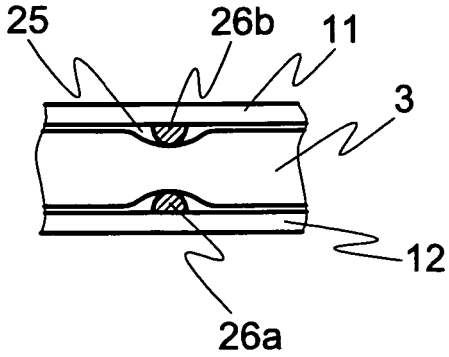
FIG. 11 is a longitudinal section diagram showing a dual embankment part in embodiment 1 of the present invention.

FIG. 11 is a longitudinal section diagram showing a dual embankment part in embodiment 1 of the present invention.

The dual embankment 26*b* and the dual embankment 26*a* are respectively furnished on the upper cover 11 and the lower cover 12 in a protruding state. The shapes of the dual embankment 26*a* or the dual embankment 26*b* is a rib shape.

Because the ink ribbon 3 passes between the dual embankment 26*a* and the dual embankment 26*b* that expand along a transverse direction of the ink ribbon movement path 25, even if the ink ribbon 3 happened dual movement, it is possible to prevent the foreside of the ink ribbon 3 from passing between the dual embankment 26*a* and the dual embankment 26*b*.

Further, because the height of the dual embankment 26*a* and the dual embankment 26*b* is higher than that of the embankment 4*a* and the embankment 4*b*, it is possible to prevent an actual dual movement. Regarding other compositions, because they are the same as that in embodiment 1, their explanations are omitted for simplification.

Operation:

According to the above-stated structure, the ink ribbon cassette and the printing apparatus of the embodiment 2 performs the following operation. Next is to explain the operation by using FIG. 12.

Figure 12:
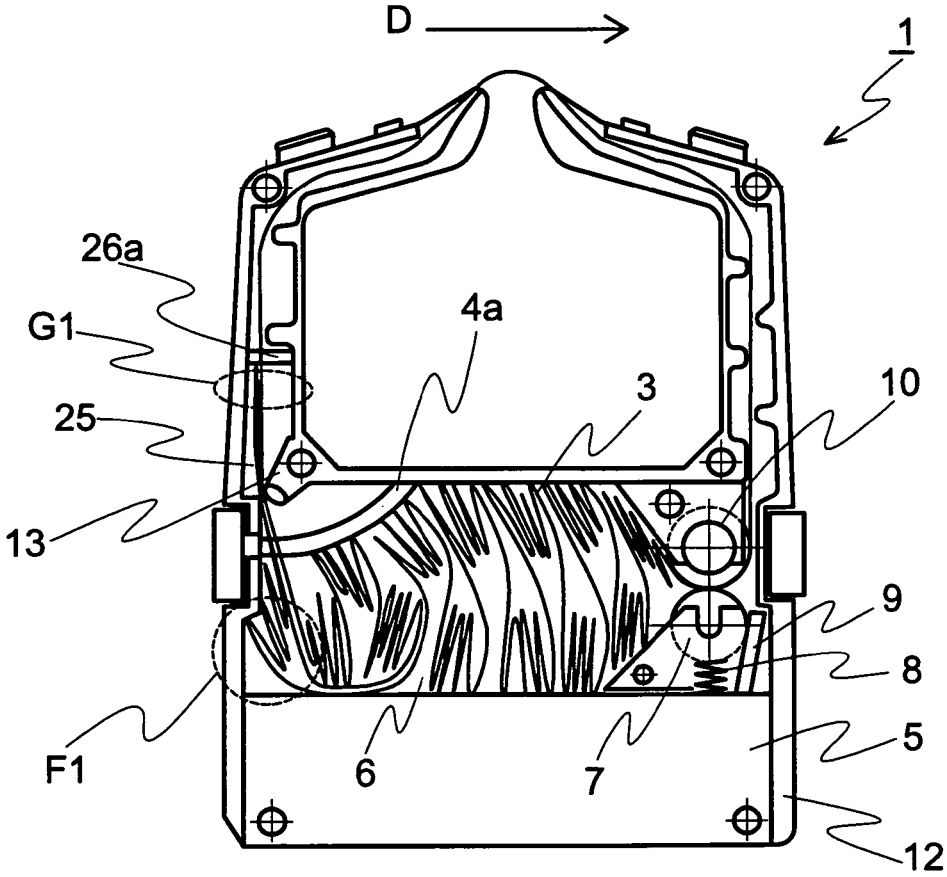
FIG. 12 is a diagram showing operation of an ink ribbon cassette in embodiment 2 of the present invention.

FIG. 12 is a diagram showing operation of an ink ribbon cassette in embodiment 2 of the present invention.

It is the same as the embodiment 1 that the ink ribbon 3 is nipped by the drive gear 10 and the transfer gear 7, and is taken into the ink ribbon lodging section 6, and then the ink ribbon 3 is lodged into the ink ribbon lodging section 6 in a folded state.

Further, as shown by area F1 on the left side of the ink ribbon 3 in FIG. 12, when the back part of the ink ribbon 3 which has outstripped the front part of the ink ribbon 3 comes, because of a friction between the front part and the back part, the back part of the ink ribbon 3 gets over the embankment 4*a* and the embankment 4*b* and is drawn out in company with the front part of the ink ribbon 3.

When the foreside of the back part of the ink ribbon 3 that has dual movement comes to a position shown by area G1, the foreside of the ink ribbon 3 that has dual movement hits the dual embankment 26*a* and the dual embankment 26*b* that expand along a lengthways direction of the ink ribbon movement path 25, and is stopped to get across the dual embankment 26*a* and the dual embankment 26*b*.

Figure 14:
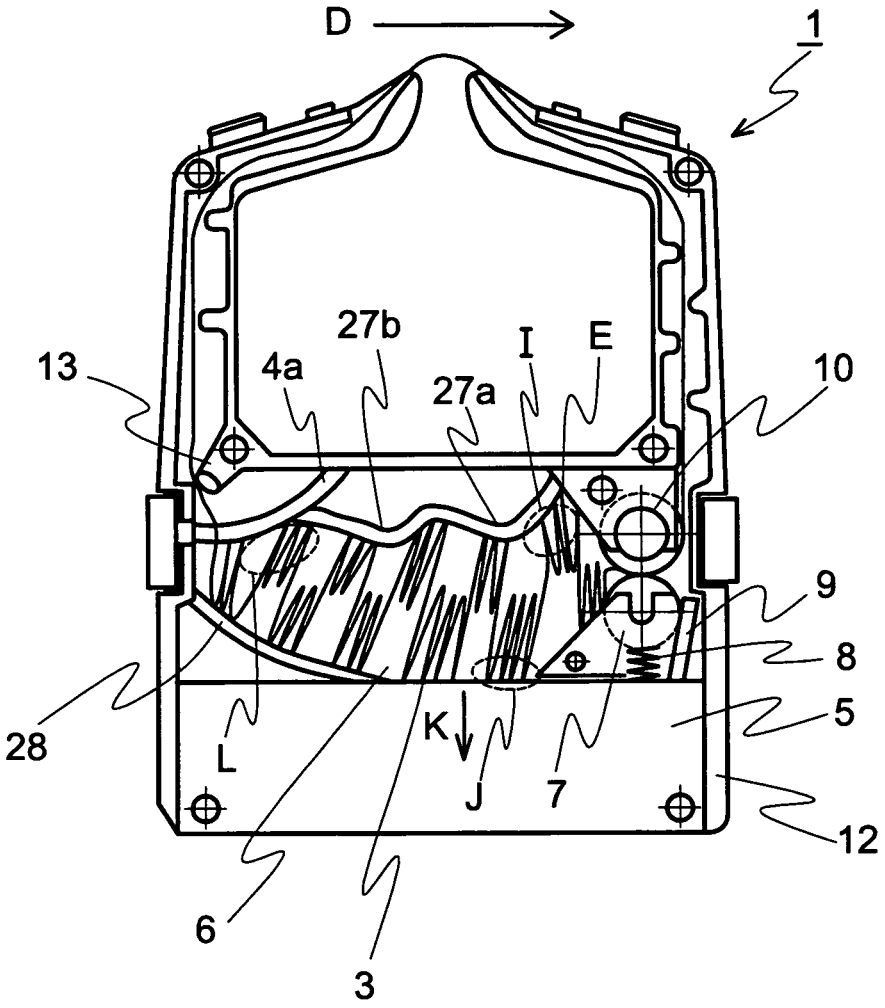
FIG. 14 is a diagram showing operation of an ink ribbon cassette in embodiment 3 of the present invention.

Further, because the height of the dual embankment 26*a* and the dual embankment 26*b* is higher than that of the embankment 4*a* and the embankment 4*b* shown by FIG. 14, it is possible to certainly prevent an actual dual movement. Moreover, because the ink ribbon 3 is smaller near the dual embankment 26*a* and the dual embankment 26*b*, the dual embankment 26*a* and the dual embankment 26*b* would not become a movement load of the ink ribbon 3.

Furthermore, in the description stated above, although only the dual embankment 26*a* and the dual embankment 26*b* are explained, it is possible to only provide either of the dual embankment 26*a* and the dual embankment 26*b*.

Effect of the Embodiment 2:

As stated in detail above, according to the ink ribbon cassette and the printing apparatus in the embodiment 2, dual embankments are provided on ink ribbon movement path on the downstream side of the ink ribbon lodging section that respectively protrude from the lower cover and the upper cover. Because of the dual embankments, and similarly to the embodiment 1, even if in the case that the ink ribbon is extended to prolong the life of the ink ribbon cassette, it is possible to prevent the ink ribbon from getting across the lengthways embankment to cause dual movement.

Embodiment 3

Figure 13:
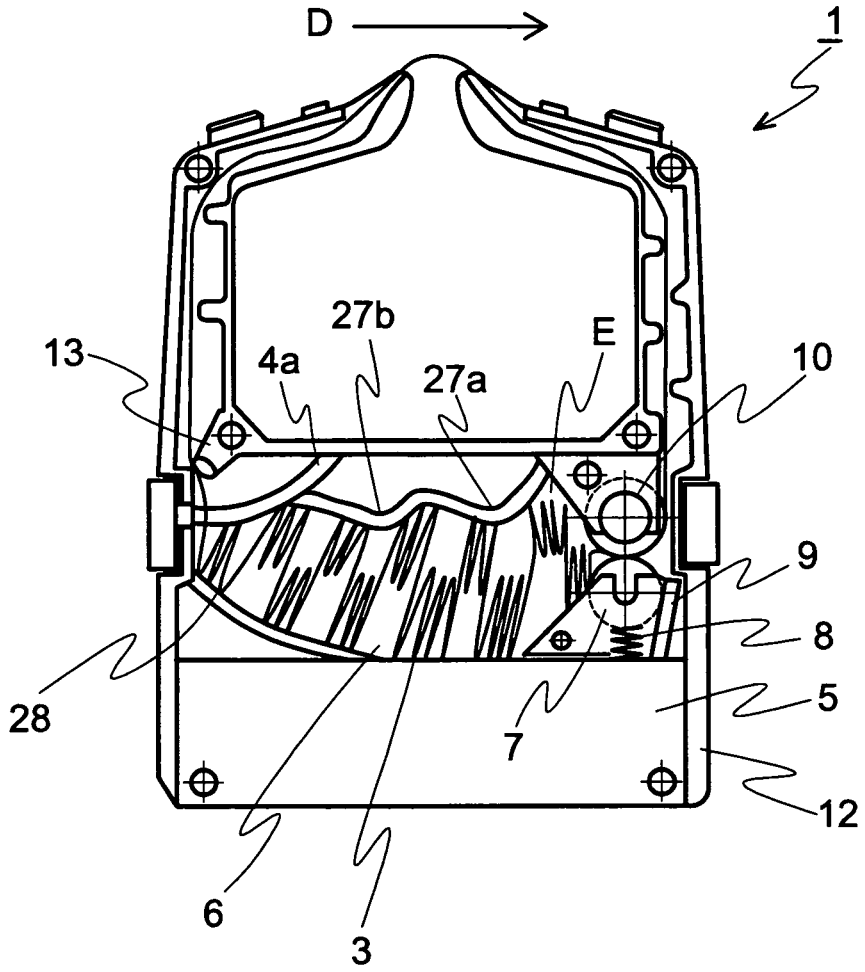
FIG. 13 is a diagram showing a structure of an ink ribbon cassette in embodiment 3 of the present invention.

Structure:

FIG. 13 is a diagram showing a structure of an ink ribbon cassette in embodiment 3 of the present invention.

As shown by FIG. 13, an ink ribbon cassette and a printing apparatus of the embodiment 3 respectively have a protruding portion 27*a* serving as a first protruding portion and a protruding portion 27*b* serving as a second protruding portion, that are provided in the ink ribbon lodging section 6. The protruding portion 27*a* and the protruding portion 27*b* respectively are a part of the lower cover 12, and are respectively furnished near the entering opening and the ejecting opening of the ink ribbon lodging section 6.

The protruding portion 27*a* presses and contacts the ink ribbon along the shape of the protruding portion 27*a*. The protruding portion 27*b* has a weaker embankment action to lighten the density of the ink ribbon 3 pressed into the ejecting opening of the ink ribbon lodging section 6. Then, in order to easily lead the ink ribbon 3 to the ejecting opening of the ink ribbon lodging section 6, as shown by FIG. 13, it is better to furnish a bending portion 28.

Regarding other compositions, because they are the same as that in embodiments 1 and 2, their explanations are omitted for simplification.

Operation:

According to the above-stated structure, the ink ribbon cassette and the printing apparatus of the embodiment 3 performs the following operation. Next is to explain the operation by using FIG. 14.

FIG. 14 is a diagram showing operation of an ink ribbon cassette in embodiment 3 of the present invention It is the same as the embodiments 1 and 2 in that the ink ribbon 3 is nipped by the drive gear 10 and the transfer gear 7, taken into the ink ribbon lodging section 6, and then the ink ribbon 3 is lodged into the ink ribbon lodging section 6 in a folded state.

When the ink ribbon 3 is taken into the space E of the ink ribbon lodging section 6 by the drive gear 10, as shown in FIG. 14, because the ink ribbon 3 is pressed along the shape of the protruding portion 27*a* and contacts the protruding portion 27*a* in a position shown at area I, the ink ribbon 3 does not enter the space E.

Further, because the ink ribbon 3 is pressed along the direction of arrow K on the opposite side of the protruding portion 27*a*, the ink ribbon 3 contacts a position shown by area J, and does not further enter. Thus, the ink ribbon 3 is sequentially lodged into the ink ribbon lodging section 6, so it becomes less possible that the back part of the ink ribbon 3 outstrips the front part of the ink ribbon 3 and is folded.

Furthermore, the protruding portion 27*b* has a weaker embankment action to lighten the density of the ink ribbon 3 pressed into a position of area L, so the ink ribbon 3 smoothly moves to the ejecting opening of the ink ribbon lodging section 6 through the bending portion 28.

According to the structure stated above, because the density of the ink ribbon 3 is adjusted toward the side of the embankment 4*a* and the embankment 4*b* from the side of the drive gear 10, the density of the ink ribbon 3 does not become high in a circumference of the embankment 4*a* and the embankment 4*b*. Therefore, it is possible to reduce friction while drawing out the ink ribbon 3.

Moreover, in the description stated above, although only the protruding portion 27*a* and the protruding portion 27*b*, i.e. two protruding portions, are described it is possible to provide more protruding portions or only one protruding portion.

Figure 15:
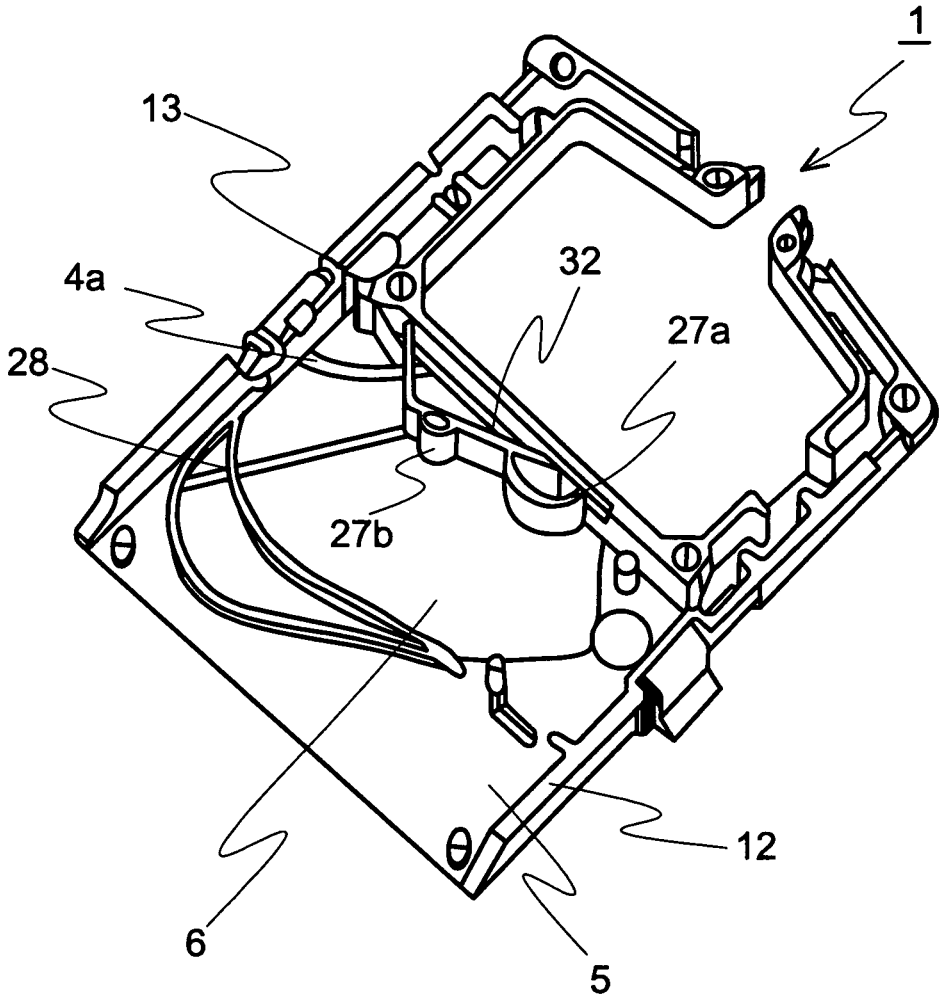
FIG. 15 is a diagram showing a structure of a lower cover in embodiment 3 of the present invention.
Figure 16:
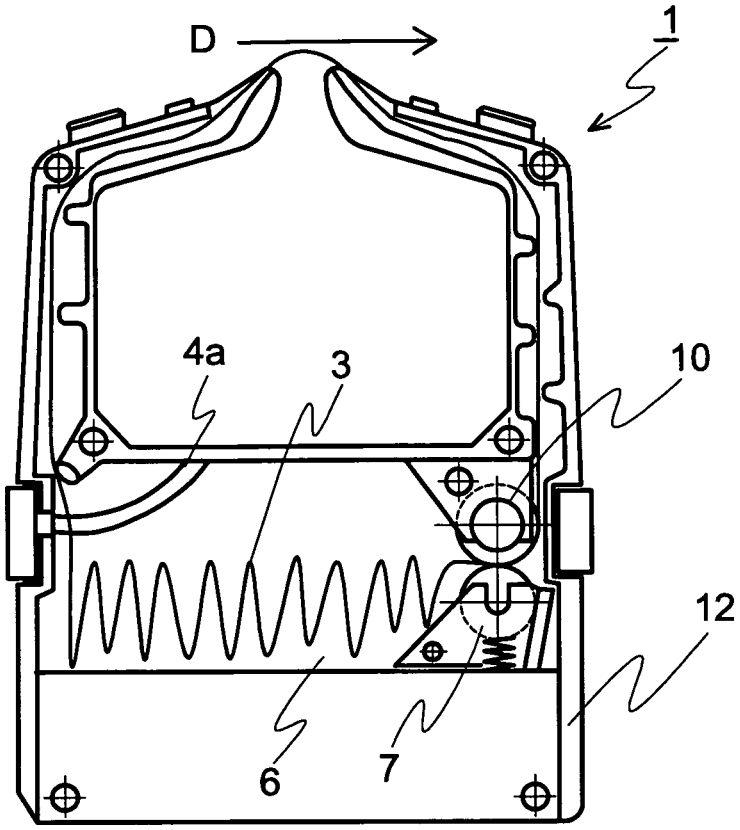
FIG. 16 is a diagram showing a structure of a conventional ink ribbon cassette.
Figure 17:
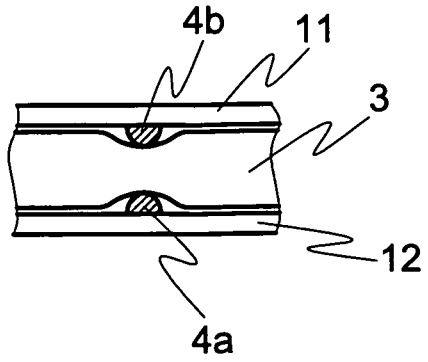
FIG. 17 is a longitudinal section diagram showing a conventional embankment part.
Figure 18:
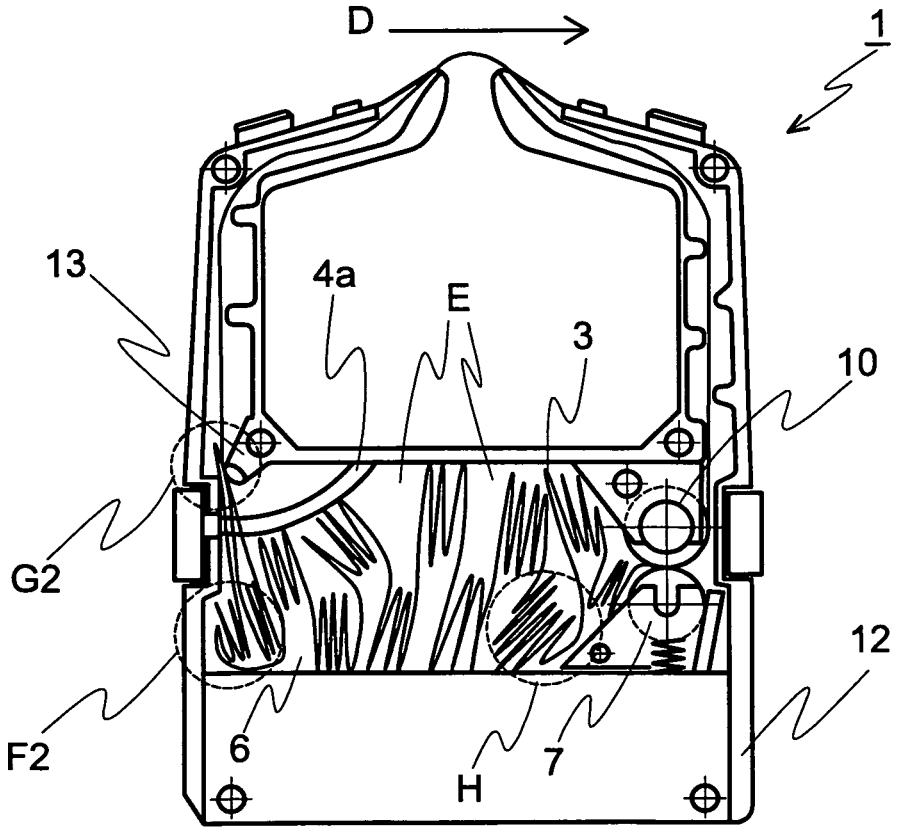
FIG. 18 is a diagram showing operation of a conventional ink ribbon cassette.

FIG. 15 is a diagram showing a structure of a lower cover in embodiment 3 of the present invention.

As shown by FIG. 15, it is possible to furnish a rib 32 in the ink ribbon lodging section 6, and to furnish the protruding portion 27*a* and the protruding portion 27*b* on the rib 32 respectively near to the entering opening and the ejecting opening of the ink ribbon lodging section 6.

Effect of the Embodiment 3:

As stated in detail above, according to the ink ribbon cassette and the printing apparatus in the embodiment 3, because the first protruding portion is provided in the space near the entering opening of the ink ribbon lodging section, the possibility becomes smaller than the back part of the ink ribbon 3 outstrips the front part of the ink ribbon 3 to be folded. Furthermore, because the second protruding portion is provided near the ejecting opening of the ink ribbon lodging section, it is possible to inhibit the density of the ink ribbon near the ejecting opening of the ink ribbon lodging section so as to reduce friction while drawing out the ink ribbon. As a result, even in the case that the ink ribbon is extended to prolong the life of the ink ribbon cassette, it is possible to prevent the ink ribbon from getting across the lengthways embankment to cause dual movement.

Transformation Example

In the embodiments 1 and 2, a structure is explained in which a bending portion 28 is not furnished in the ink ribbon lodging section 6. However, the bending portion 28 may be furnished as described in embodiment 3. Thus, it is possible to further smoothly move the ink ribbon 3 to the ejecting opening of the ink ribbon lodging section 6.

The Utilization Possibility in Industry:

Not only the present invention can be applied to the above stated case, but also the present invention can be applied to various printing apparatus using the ink ribbon cassette.

The present invention is not limited to the foregoing embodiments but many modifications and variations are possible within the spirit and scope of the appended claims of the invention.

What is claimed is:

1. An ink ribbon cassette comprising:

a first cover;

a second cover;

an ink ribbon lodging section that includes the first cover and the second cover and lodges ink ribbon in a folded state;

a driving section that takes the ink ribbon from an enter opening of the ink ribbon lodging section into the ink ribbon lodging section and draws the ink ribbon out of the ink ribbon lodging section from an ejecting opening of the ink ribbon lodging section;

a first embankment, furnished proximate the ejecting opening and inside the ink ribbon lodging section, for pushing the ink ribbon in a width direction of the ink ribbon;

a movement path furnished between the first cover and the second cover and outside the ink ribbon lodging section, the movement path being disposed so that the ink ribbon drawn out from the ejecting opening of the ink ribbon lodging section moves in the movement path in a movement direction towards the enter opening, and is then taken from the enter opening into the ink ribbon lodging section;

a guide member that is furnished in the movement path and formed in the movement path so as to make the movement path narrower in a thickness direction of the ink ribbon; and a pair of second embankments, furnished in the movement path and proximate the ejecting opening of the ink ribbon lodging section, for pushing the ink ribbon in the width direction of the ink ribbon, the second embankments each having a rib, the ribs of the second embankments protruding toward an inside of the movement path from both of the first cover and the second cover, the second embankments being disposed downstream of the guide member in the movement direction of the ink ribbon in the movement path, each of the second embankments having a length along the width direction of the ink ribbon that is greater than a length of the first embankment along the width direction of the ink ribbon, when the driving section moves the ink ribbon in the movement direction, the ink ribbon is drawn from the ink ribbon lodging section into the movement path through the ejecting opening, traverses the first embankment, the guide member and the second embankments in that stated order, and is subsequently drawn into the ribbon lodging section through the enter opening.

2. The ink ribbon cassette according to claim 1, further including:

a side wall rib furnished at a side wall of the ink ribbon lodging section; and first and second protruding portions furnished on the side wall rib, the first protruding portion being placed proximate the enter opening of the ink ribbon lodging section and being larger than the second protruding portion, the second protruding portion being placed proximate the ejecting opening of the ink ribbon lodging section.

3. The ink ribbon cassette according to claim 2, wherein a curvature of the first protruding portion is greater than a curvature of the second protruding portion.

4. The ink ribbon cassette according to claim 1, wherein a length of the ink ribbon taken along the width direction of the ink ribbon is greater than a length of the ink ribbon taken along the thickness direction of the ink ribbon.

5. The ink ribbon cassette according to claim 1, wherein the width direction of the ink ribbon is perpendicular to both the first and second covers, and the thickness direction of the ink ribbon is parallel to both the first and second covers, and both the width direction of the ink ribbon and the thickness direction of the ink ribbon are perpendicular to a direction of travel of the ink ribbon.

6. The ink ribbon cassette according to claim 1, wherein a portion of the ink ribbon is lodged into the ink ribbon lodging section such that the portion of the ink ribbon is not disposed around any rollers.

7. A printing apparatus including the ink ribbon cassette of claim 1.

8. A printing apparatus including the ink ribbon cassette of claim 2.

9. A printing apparatus including the ink ribbon cassette of claim 3.

10. A printing apparatus including the ink ribbon cassette of claim 4.

11. A printing apparatus including the ink ribbon cassette of claim 5.

12. A printing apparatus including the ink ribbon cassette of claim 6.

13. The ink ribbon cassette according to claim 1, wherein the first cover and the second cover are each perpendicular to the width direction.

14. The ink ribbon cassette according to claim 1, wherein the movement path is disposed completely outside the ink ribbon lodging section.

15. The ink ribbon cassette according to claim 1, wherein the guide member is disposed in a part of the movement path that extends along the movement direction and from the first embankment to the second embankments.

* * * * *